US009352352B2

(12) United States Patent
Wu et al.

(10) Patent No.: US 9,352,352 B2
(45) Date of Patent: May 31, 2016

(54) GLUING NOZZLE

(71) Applicants: FU DING ELECTRONICAL TECHNOLOGY (JIASHAN) CO., LTD., Zhejiang (CN); HON HAI PRECISION INDUSTRY CO., LTD., New Taipei (TW)

(72) Inventors: Huo-Zhong Wu, Jiashan (CN); Jian-Qiang Lu, Jiashan (CN); Jian-Hua Xu, Jiashan (CN)

(73) Assignees: FU DING ELECTRONICAL TECHNOLOGY (JIASHAN) CO., LTD., Zhejiang (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/324,394

(22) Filed: Jul. 7, 2014

(65) Prior Publication Data

US 2015/0014371 A1 Jan. 15, 2015

(30) Foreign Application Priority Data

Jul. 5, 2013 (CN) ..... 2013 2 0398880 U

(51) Int. Cl.

*B65D 5/72* (2006.01)
*B05C 7/00* (2006.01)
*B05B 15/06* (2006.01)

(52) U.S. Cl.

CPC *B05C 7/00* (2013.01); *B05B 15/065* (2013.01)

(58) Field of Classification Search

CPC ..... B65D 25/48; B65D 25/40; B65D 25/42; B65D 35/38; B05C 17/00503; B05C 17/00516; B05C 17/00509; B05C 7/00; F16N 5/02; B05B 15/065

USPC ..... 222/566–568, 498, 499, 575, 92, 106, 222/107, 391, 389

See application file for complete search history.

(56) References Cited

U.S. PATENT DOCUMENTS

| | | | | | |
|---|---|---|---|---|---|
| 1,166,739 | A * | 1/1916 | Bell | 222/330 | |
| 2,754,033 | A * | 7/1956 | Etter | 222/326 | |
| 2,833,444 | A * | 5/1958 | Sherbondy | B05C 17/00506 | 222/105 |
| 4,619,613 | A * | 10/1986 | Dragan | A61C 9/0026 | 222/575 |
| 5,445,523 | A * | 8/1995 | Fischer et al. | 433/90 | |
| 5,695,339 | A * | 12/1997 | Abere | A61C 13/0003 | 433/218 |
| 5,843,048 | A * | 12/1998 | Gross | 604/264 | |
| D476,538 | S * | 7/2003 | Dorff et al. | D8/14.1 | |
| 6,688,500 | B1 * | 2/2004 | Cheng | 222/482 | |
| 6,905,335 | B2 * | 6/2005 | Fischer | 433/77 | |
| 2005/0173472 | A1 * | 8/2005 | Page | B05C 17/00516 | 222/568 |
| 2011/0256501 | A1 * | 10/2011 | Lampert | A61C 5/062 | 433/90 |

* cited by examiner

*Primary Examiner* — Lien Ngo

(74) *Attorney, Agent, or Firm* — Novak Druce Connolly Bove + Quigg LLP

(57) ABSTRACT

A gluing nozzle can include a base defining a receiving cavity, and a tube coupled to the base. The tube can include a straight portion mounted to the base, and a bent portion bent from the straight portion. The tube can define a channel fluidly communicating with the receiving cavity, the straight portion, and the bent portion. The channel can extend through an outlet of the bent portion. A distal end of the bent portion can form an annular surface surrounding the outlet. The annular surface can be substantially parallel to an axis of the straight portion.

13 Claims, 3 Drawing Sheets

GLUING NOZZLE

FIELD

The present disclosure relates to gluing nozzles.

BACKGROUND

A glue dispenser uses a gluing nozzle for dispensing glue.

BRIEF DESCRIPTION OF THE DRAWINGS

Implementations of the present technology will now be described, by way of example only, with reference to the attached figures.

DETAILED DESCRIPTION

Figure 1:
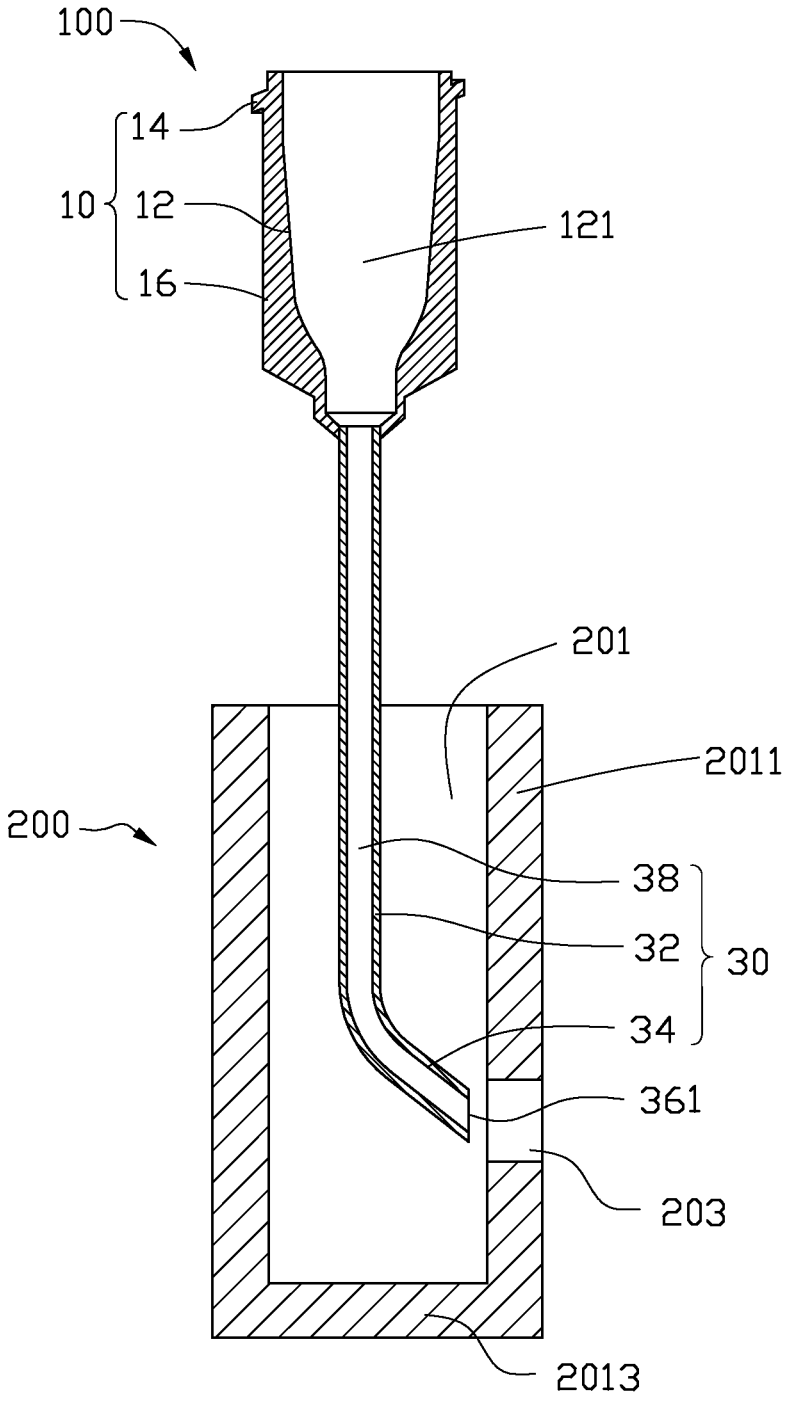
FIG. 1 is a cross-sectional view of an embodiment of a gluing nozzle.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

A gluing nozzle can include a base defining a receiving cavity, and a tube coupled to the base. The tube can include a straight portion mounted to the base, a bent portion formed at an end of the straight portion away from the base, and a gluing end formed at an end of the bent portion away from the straight portion. The straight portion can define a channel fluidly communicating with the receiving cavity. The channel can extend through the bent portion and the gluing end, and can define an outlet at an end of the gluing end. The gluing end can define an annular surface surrounding the outlet. The annular surface can be substantially parallel to an axis of the straight portion. A projection of the outlet along a normal line of the gluing end can be an ellipsoid.

FIG. 1 illustrates an embodiment of a gluing nozzle 100 configured to apply a coat of glue to a workpiece 200. The workpiece 200 can include two sidewalls 2011 and a bottom wall 2013. In the illustrated embodiment, the two sidewalls 2011 and the bottom wall 2013 can cooperatively define a slot 201, and a gluing hole 203 can be defined in one of the sidewalls 2011. The gluing nozzle 100 can extend into the slot 201 and dispense glue into the gluing hole 203. Thus, the gluing hole 203 can be sealed by the glue.

Figure 2:
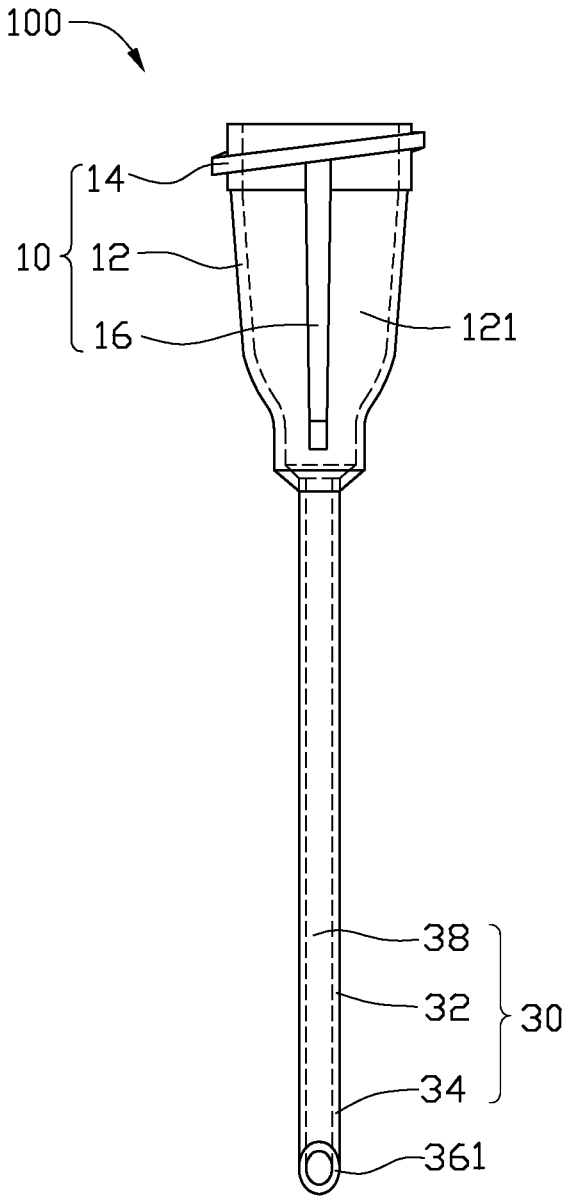
FIG. 2 is a side view of the gluing nozzle of FIG. 1.

Referring to FIG. 2, the gluing nozzle 100 can include a base 10 and a tube 30. The base 10 can include a main body 12, a mounting portion 14, and at least one positioning portion 16. The mounting portion 14 and the positioning portion 16 can be coupled to the main body 12. In at least one embodiment, the base 10 can be made of plastic.

The main body 12 can be substantially a hollow structure and define a receiving cavity 121. The receiving cavity 121 can extend through opposite ends of the main body 12. In at least one embodiment, the receiving cavity 121 can be configured to receive a container for receiving glue. In another embodiment, the receiving cavity 121 can be configured to receive glue directly. In at least one embodiment, the mounting portion 14 can be a threaded portion. The base 10 can be mounted to a gluing device (not shown) via the mounting portion 14. The positioning portion 16 can be substantially a ribbed plate. In the illustrated embodiment, there can be two positioning portions 16. Each positioning portion 16 can protrude along a radial direction of the main body 12, and extend along a longitudinal direction of the main body 12. The two positioning portions 16 can be formed on opposite sides of the main body 12 and can be substantially symmetrical to each other. The two positioning portions 16 can be used to fix a position of the base 10 when the gluing nozzle 100 is mounted to the gluing dispenser (not shown).

The tube 30 can be substantially a hollow structure. An end of the tube 30 can be coupled to the main body 12. In at least one embodiment, a thickness of a sidewall of the tube 30 can be uniform.

Figure 3:
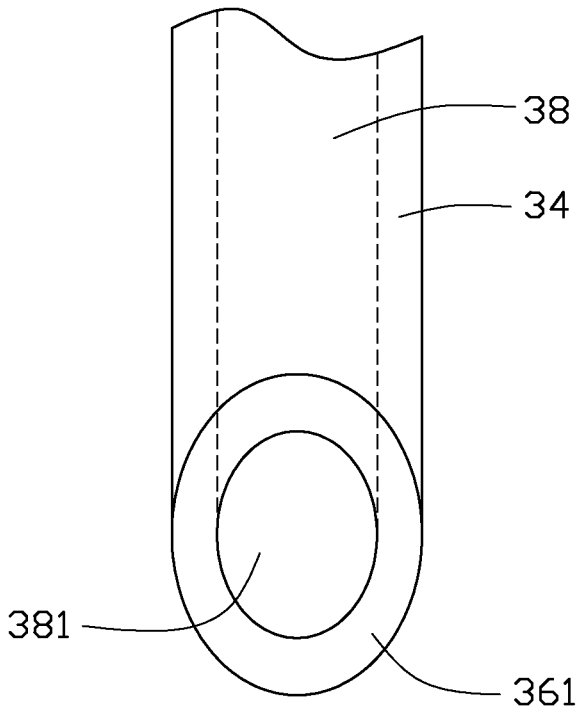
FIG. 3 is an enlarged view of a bent portion of the gluing nozzle of FIG. 1.

Referring to FIGS. 2 and 3, the straight portion 32 can be substantially a straight tube, and an end of the straight portion 32 can be coupled to an end of the main body 12. The bent portion 34 can be bent from another end of the straight portion 32. An axis of the bent portion 34 can cross an axis of the straight portion 32 at a certain angle. In the illustrated embodiment, the angle defined between the axis of the bent portion 34 and the axis of the straight portion 32 can be more than 90 degrees (shown in FIG. 1). In an alternative embodiment, the angle can be substantially 90 degrees. The straight portion 32 and the bent portion 34 can be smoothly joined together. The channel 38 can extend through the straight portion 32 and the bent portion 34. A distal end of the bent portion 34 can define an outlet 381. The channel 38 can fluidly communicate with the outside via the outlet 381. The distal end of the bent portion 34 can form an annular surface 361 surrounding the outlet 381. The annular surface 361 can be configured to resist against an inner surface of the sidewalls 2011. In the illustrated embodiment, the annular surface 361 can be substantially parallel to the axis of the straight portion 32. (see FIG. 1).

In operation, the base 10 of the gluing nozzle 100 can be mounted to a glue dispenser (not shown), and the tube 30 can extend into the slot 201 of the workpiece 200. The outlet 381 can be aligned to the gluing hole 203. The glue dispenser can press the main body 12, and the glue contained in the receiving cavity 121 can be squeezed out from the main body 12.

The glue can flow through the channel 38 and out of the outlet 381 to flow into and fill the gluing hole 203.

In an alternative embodiment, the gluing nozzle 100 can also be used to dispense glue onto an inner surface of the workpiece 200. The bottom wall 2013 of the workpiece 200 can be omitted. The slot 201 can be defined in a surface of the workpiece 200 and can extend through an opposite surface thereof.

In an alternative embodiment, the thickness of the tube 30 can be uneven. For example, the thickness of the tube 30 can gradually increase or decrease along a longitudinal direction of the bent portion 34.

In an alternative embodiment, the mounting portion 14 can be omitted, such that the gluing nozzle 100 can be mounted to the glue dispenser (not shown) by a fixture of the glue dispenser. The positioning portion 16 can be omitted, such that the gluing nozzle 100 can be positioned by a positioning member (not shown) of the fixture on the glue dispenser. In an alternative embodiment, a number of the positioning portion 16 can be one or more than one.

In an alternative embodiment, the base 10 can be made of other materials, such as metal. The tube 30 can be made of other materials, such as plastic or metal. The tube 30 and the main body 12 can be coupled to each other by interference fit. In an alternative embodiment, the base 10 can be injection molded onto the tube 30.

The embodiments shown and described above are only examples. Many details are often found in the art such as the other features of a piston. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including the full extent established by the broad general meaning of the terms used in the claims. It will therefore be appreciated that the embodiments described above may be modified within the scope of the claims.

The invention claimed is:

1. A gluing nozzle comprising:

a base defining a receiving cavity, and a tube coupled to the base and comprising:

a straight portion mounted to the base;

a bent portion formed at an end of the straight portion away from the base, wherein the straight portion defines a channel fluidly communicating with the receiving cavity; the channel extends through the bent portion, a gluing end is formed at an end of the bent portion away from the straight portion, and the gluing end of the bent portion defines an outlet and form an annular surface surrounding the outlet; the annular surface is parallel to an axis of the straight portion, and a thickness of the tube is uniform, and a projection of the outlet along a normal line of the gluing end is an ellipsoid.

2. The gluing nozzle of claim 1, wherein an angle defined by an axis of the bent portion and an axis of the straight portion is more than 90 degrees.

3. The gluing nozzle of claim 1, wherein the base comprises a main body and a mounting portion formed on the main body, the mounting portion is positioned at an end of the main body away from the tube.

4. The gluing nozzle of claim 1, wherein the base comprise a main body and at least one positioning portion coupled to the main body, the at least one positioning portion protrudes along a radial direction of the main body, and extends along a longitudinal direction of the main body.

5. The gluing nozzle of claim 1, wherein the base is injection molded onto the tube.

6. The gluing nozzle of claim 1, wherein the base is made of plastic.

7. The gluing nozzle of claim 1, wherein the base is made of metal.

8. The gluing nozzle of claim 1, wherein the tube is made of stainless steel.

9. A gluing nozzle comprising:

a base defining a receiving cavity, and a tube coupled to the base and comprising:

a straight portion mounted to the base;

a bent portion formed at an end of the straight portion, wherein the straight portion defines a channel fluidly communicating with the receiving cavity and extending through the bent portion, a gluing end is formed at an end of the bent portion away from the straight portion and the gluing end of the bent portion defines an outlet and form an annular surface surrounding the outlet; the annular surface is parallel to an axis of the straight portion, and a thickness of the tube is uniform, and a projection of the outlet along a normal line of the gluing end is an ellipsoid.

10. The gluing nozzle of claim 9, wherein an angle defined by an axis of the bent portion and an axis of the straight portion is more than 90 degrees.

11. The gluing nozzle of claim 9, wherein an angle defined by an axis of the bent portion and an axis of the straight portion is 90 degrees.

12. A gluing nozzle comprising:

a base defining a receiving cavity; and a tube coupled to the base and comprising:

a straight portion coupled to the base and defining a channel therein that is coupled to the receiving cavity; and a bent portion formed at an end of the straight portion away from the base, a gluing end formed at an end of the bent portion away from the straight portion, and the guiding end defining an annular surface through which an outlet is formed, wherein the channel extends through the bent portion to the out and the annular surface is parallel to an axis of the straight portion, a thickness of the tube is uniform, and a projection of the outlet along a normal line of the gluing end is an ellipsoid.

13. The gluing nozzle of claim 12, wherein an angle defined by an axis of the bent portion and an axis of the straight portion is 90 degrees or more than 90 degrees.

* * * * *